US008131168B2

(12) United States Patent
Omoya

(10) Patent No.: US 8,131,168 B2
(45) Date of Patent: Mar. 6, 2012

(54) IMAGE FORMING APPARATUS THAT DETERMINES A FAILURE IN AN EXPOSURE SECTION BASED ON A DETECTED DENSITY OF A TONER IMAGE

(75) Inventor: Shinichi Omoya, Osaka (JP)

(73) Assignee: Kyocera Mita Corporation (JP)

( * ) Notice: Subject to any disclaimer, the term of this patent is extended or adjusted under 35 U.S.C. 154(b) by 396 days.

(21) Appl. No.: 12/467,457

(22) Filed: May 18, 2009

(65) Prior Publication Data

US 2009/0290884 A1 Nov. 26, 2009

(30) Foreign Application Priority Data

May 23, 2008 (JP) ..... 2008-135329

(51) Int. Cl.
*G03G 15/04* (2006.01)

(52) U.S. Cl. ..... 399/32

(58) Field of Classification Search ..... 399/27, 399/31, 32, 47, 49; 347/129, 235, 250; 358/1.14
See application file for complete search history.

(56) References Cited

U.S. PATENT DOCUMENTS 5,576,811 A * 11/1996 Kobayashi et al. ..... 399/60
5,673,106 A * 9/1997 Thompson ..... 399/9
5,708,916 A * 1/1998 Mestha ..... 399/49
5,722,007 A * 2/1998 Ogata et al. ..... 399/49
6,081,348 A * 6/2000 Budnik et al. ..... 358/406
7,907,853 B2 * 3/2011 Takesue et al. ..... 399/8
2005/0248801 A1 * 11/2005 Miyahara et al. ..... 358/1.14

FOREIGN PATENT DOCUMENTS

JP 03229282 A * 10/1991
JP 2003-200609 7/2003

* cited by examiner

*Primary Examiner* — Robert Beatty
(74) *Attorney, Agent, or Firm* — Gerald E. Hespos; Michael J. Porco

(57) ABSTRACT

An image forming apparatus provided with an image forming section, including: a toner density detection section which detect a density of a toner image transferred onto an intermediate transfer member; a density correction section which executes density correction processing of the toner image forming in a case where a density value detected by the density detection section does not satisfy a predetermined condition; a toner remaining amount detector which detects a toner remaining amount of a toner accumulation section; and a determination section which determines that failure has occurred in the exposure section if the density value detected by the density detection section does not satisfy the predetermined condition after the density correction processing executed by the density correction section is terminated, and the toner remaining amount detected by the toner remaining amount detector is greater than a predetermined remaining amount.

10 Claims, 11 Drawing Sheets

IMAGE FORMING APPARATUS THAT DETERMINES A FAILURE IN AN EXPOSURE SECTION BASED ON A DETECTED DENSITY OF A TONER IMAGE

BACKGROUND OF THE INVENTION

1. Field of the Invention

The present invention relates to image forming apparatuses. More particularly, it relates to a technology for detecting failure which has occurred in an exposure section which performs light exposure by irradiating a light to a surface of a photosensitive member.

2. Description of the Related Art

Conventionally, in an image forming apparatus adopting an electrophotographic method, a light scanning device has been adopted which irradiates a light to a surface of a photosensitive drum by reflecting a laser light beam irradiated from a light source such as a laser diode with a light deflector such as a rotating multifaceted mirror to form an electrostatic latent image on the surface of the photosensitive drum. In such light scanning device, a BD sensor which receives a laser light beam at a predetermined position is provided, and a technology for setting a start timing (start position) of light beam scanning with use of an output signal (horizontal synchronizing signal) of the BD sensor has been disclosed in, for example, Japanese Patent Unexamined Publication No. 2003-200609.

In an image forming apparatus capable of performing color image forming, for the purpose of providing image forming units for respective colors, thus an exposure section and a laser diode are provided for each color. Further, for the purpose of speeding up the operation in an image forming apparatus, there has been also adopted a mechanism for simultaneously scanning a plurality of lines with use of a plurality of laser diodes provided in one exposure section. In the scanner unit provided with a plurality of laser diodes, there is a case where the BD sensor for horizontal synchronization is provided, for example, in a ratio of one for two (two colors) laser diodes, for the purpose of reducing the cost. In such case, a laser light which enters the BD sensor is either one of the two (two colors) laser diodes.

The laser diode may be deteriorated by electric stress due to a static electricity and a surge. The deteriorated laser diode weakens the light quantity of emitted light and cannot obtain the light quantity necessary for image forming, thereby causing a phenomenon which makes the density of a developed image be thin. However, as described above, in the case of the image forming apparatus adopting the configuration of performing horizontal synchronization of two (two colors) laser diodes with one BD sensor, failure in the laser diode which is so set as to receive the light at the BD sensor can be detected based on no reception of the light at the BD sensor, but failure in the laser diode which is so set as not to receive the light at the BD sensor cannot be detected in the aforementioned method. Therefore, there is likelihood that printing is continued even if there is failure in the laser diode which is so set as not to receive the light at the BD sensor.

SUMMARY OF THE INVENTION

The present invention was made by further improving the conventional technologies.

In summary, an image forming apparatus in accordance with an aspect of the present invention includes: a photosensitive member having a surface on which a latent image is formed; a charging section which charges the surface of the photosensitive member; an exposure section which irradiates a light onto the surface of the photosensitive drum charged by the charging section to form the latent image; a developing section which supplies toner onto the latent image formed on the surface of the photosensitive member to form a toner image; an intermediate transfer member to which the toner image formed on the surface of the photosensitive member is transferred; a transfer section which transfers the toner image onto the intermediate transfer member; a density detection section which detects a density of the toner image transferred onto the intermediate transfer member; a density correction section which executes density correction processing of the toner image forming in a case where a density value detected by the density detection section does not satisfy a predetermined condition; a toner remaining amount detector which detects a toner remaining amount of a toner accumulation section which supplies toner to the developing section; and a determination section which determines that failure has occurred in the exposure section if the density value detected by the density detection section does not satisfy the predetermined condition after the density correction processing by the density correction section is terminated, and the toner remaining amount detected by the toner remaining amount detector is greater than a predetermined remaining amount.

These and other objects, features and advantages of the present invention will become more apparent upon reading of the following detailed description along with the accompanied drawings.

DETAILED DESCRIPTION OF THE PREFERRED EMBODIMENTS

Figure 1:
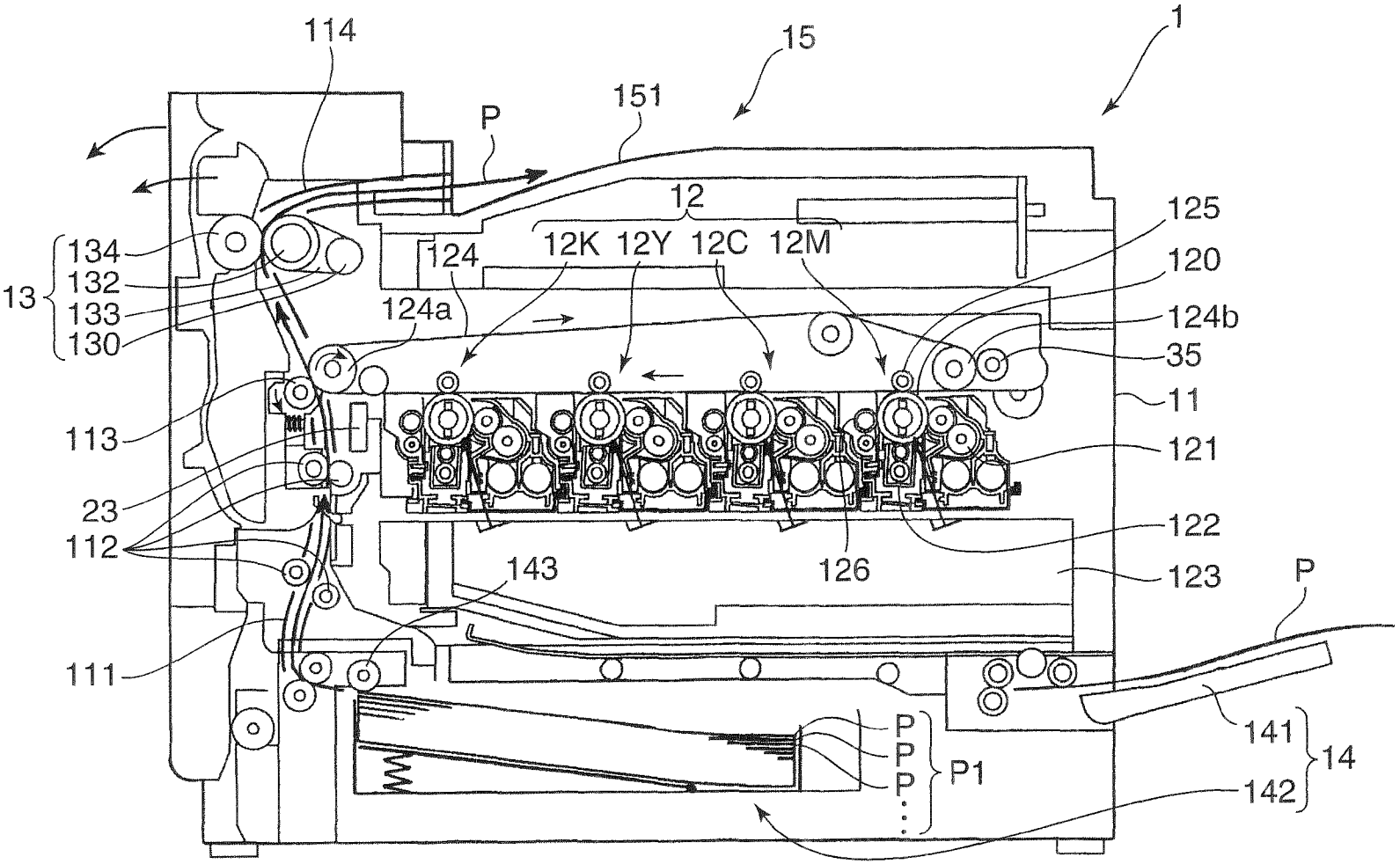
FIG. 1 is a sectional view showing an overall configuration of a printer in accordance with an embodiment of the present invention.
Figure 2:
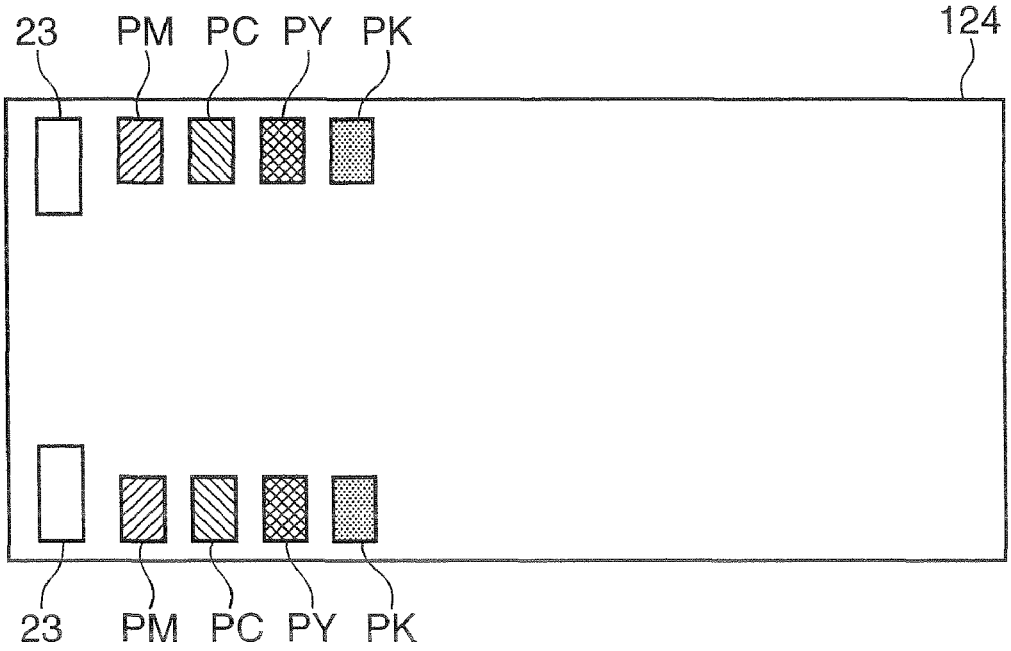
FIG. 2 is a schematic view showing an intermediate transferring belt, on which toner patterns for density detection are formed, and toner density detection sensors.
Figure 3:
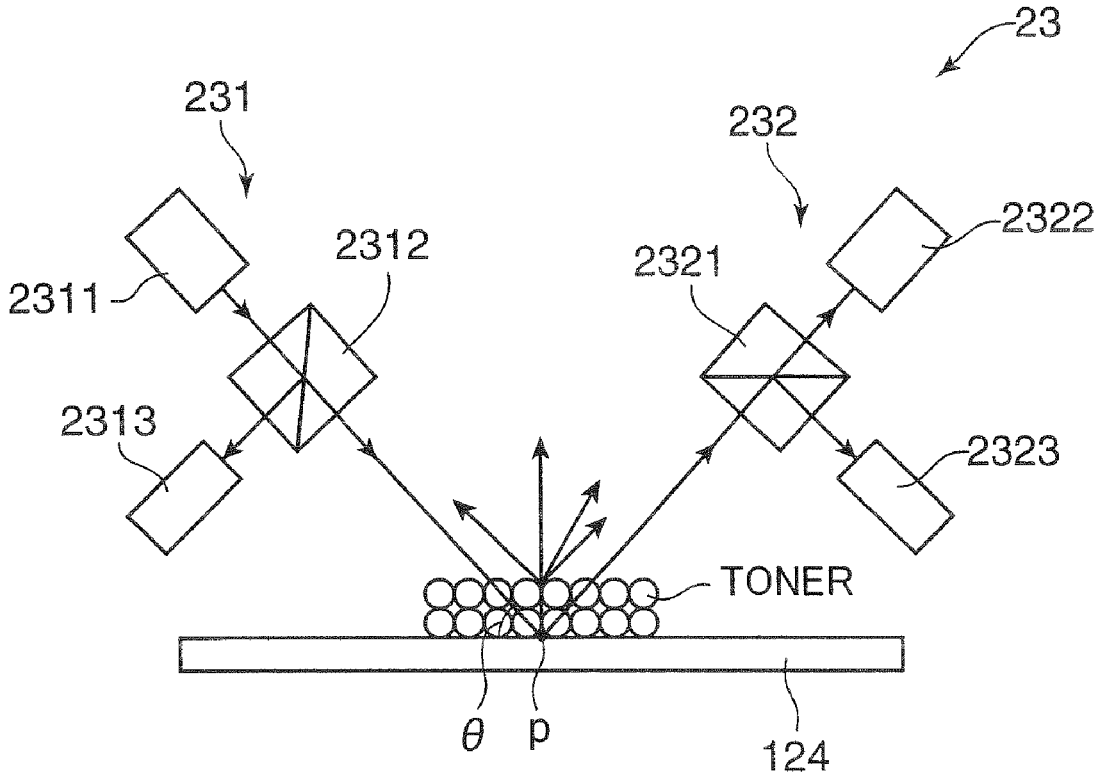
FIG. 3 shows a configuration of the toner density detection sensor.

Hereinafter, an embodiment of the present invention will be described with reference to the drawings. FIG. 1 is a sectional view showing an overall configuration of a printer in accordance with an embodiment of the present invention. FIG. 2 is a schematic view showing an intermediate transferring belt, on which toner patterns for density detection are formed, and a toner density detection sensor. FIG. 3 shows a configuration of the toner density detection sensor.

An internal structure of a printer (an example of an image forming apparatus) 1 in accordance with an embodiment of the present invention will be schematically described. As shown in FIG. 1, the printer 1 in accordance with the present embodiment has a box-shaped apparatus main body 11. In the apparatus main body 11, there are provided an image forming section 12 which forms an image based on image data transmitted from an external equipment such as a computer which is connected to a network or the like, a fixing section 13 which applies fixing processing to the image formed by the image forming section 12 and transferred to a recording sheet P, and a sheet storage section 14 which stores a recording sheet for transfer. On top of the apparatus main body 11, there is formed a sheet discharging section 15 onto which the recording sheet applied with the fixing processing is discharged.

On a front side in an upper portion of the apparatus main body 11, there is provided an unillustrated operation panel for input operation of output condition of a recording sheet P. The operation panel is provided with a power key, a start button, various keys for inputting output conditions, and the like. Further, the operation panel is provided with a display portion (unillustrated), and the display portion displays status, condition, and the like of operation of the printer 1.

The image forming section 12 forms a toner image on a recording sheet P which is fed from the sheet storage section 14. In the present embodiment, the image forming section 12 includes a magenta unit 12M using magenta toner, a cyan unit 12C using cyan toner, a yellow unit 12Y using yellow toner, and a black unit 12K using black toner. The units 12M, 12C, 12Y, and 12K are arranged sequentially from an upstream side (right side in FIG. 1) toward a downstream side.

Each of the units 12M, 12C, 12Y, and 12K includes a photosensitive drum (photosensitive member) 120 and a developing section 121. The photosensitive drum 120 is adapted to form on its peripheral surface an electrostatic latent image and a toner image (visible image) based on the electrostatic latent image, and an amorphous silicon layer is layered on the peripheral surface. The photosensitive drum 120 of each unit receives supply of toner from the developing section 121 while rotating in the counter-clockwise direction in FIG. 1.

At a position immediately below each photosensitive drum 120, there is provided a charging section 122, and at a position under the charging section 122, there is provided an exposure section 123. The peripheral surface of each photosensitive drum 120 is uniformly charged by the charging section 122, and the exposure section 123 irradiates a laser light, which corresponds to a color based on image data inputted from the computer or the like, with respect to the peripheral surface of the charged photosensitive drum 120. Accordingly, the electrostatic latent image is formed on the peripheral surface of each photosensitive drum 120. The toner is supplied to the electrostatic latent image from the developing section 121, so that the toner image is formed on the peripheral surface of the photosensitive drum 120. The developing section 121 receives supply of toner from a toner container (unillustrated) in which the toner is stored.

At a position above the photosensitive drums 120, there is provided an intermediate transferring belt (intermediate transfer member) 124 extending between a driving roller 124*a* and a driven roller 124*b*. The intermediate transferring belt 124 is provided so as to be in contact with each of the photosensitive drums 120. The intermediate transferring belt 124 rotates (endlessly rotates) between the driving roller 124*a* and the driven roller 124*b* in synchronism with each of the photosensitive drums 120 in such a state of being pressed against the peripheral surfaces of the photosensitive drums 120 by primary transfer rollers 125 provided correspondingly to the photosensitive drum 120.

When the intermediate transferring belt 124 rotates, the primary transfer rollers 125 allow the toner image of magenta toner from the photosensitive drum 120 of the unit 12M to be transferred onto the peripheral surface of the intermediate transferring belt 124, allow the toner image of cyan toner from the photosensitive drum 120 of the cyan unit 12C to be transferred in superimposition onto the same position on the intermediate transferring belt 124, allow the toner image of yellow toner from the photosensitive drum 120 of the yellow unit 12Y to be transferred in superimposition onto the same position on the intermediate transferring belt 124, and allow the toner image of black toner from the photosensitive drum 120 of the black unit 12K to be transferred in superimposition. This allows a color toner image to be transferred onto the peripheral surface of the intermediate transferring belt 124. The color toner image formed on the peripheral surface of the intermediate transferring belt 124 is transferred onto a recording sheet P conveyed from the sheet storage section 14. The units in the image forming section 12 form toner patterns PM, PC, PY, PK (FIG. 2) onto the intermediate transferring belt 124 under a control executed by a pattern formation controller 104 (FIG. 4) which will be described later.

Each photosensitive drum 120 is provided with a cleaning device 126 adapted to remove toner remaining on the peripheral surface of the photosensitive drum 120 to clean the peripheral surface. The peripheral surface of the photosensitive drum 120 cleaned by the cleaning device 126 moves toward the charging section 122 for new charging processing.

At a position facing the driving roller 124*a* for driving the intermediate transferring belt 124, there is provided a secondary transferring roller (secondary transferring section) 113 in a state of being in contact with the peripheral surface of the intermediate transferring belt 124. A nip portion clamping the intermediate transferring belt 124 between the driving roller 124*a* and the secondary transferring roller 113, a sheet conveying passage 111 is formed which extends in a vertical direction in FIG. 1. At a suitable portion in the sheet conveying passage 111, there is provided a pair of conveying rollers 112, and a recording sheet from the sheet storage section 14 is conveyed to a nip portion between the intermediate transferring belt 124 and the secondary transferring roller 113 by driving of the pair of conveying rollers 112. At the nip portion between the intermediate transferring belt 124 and the secondary transferring roller 113 in the sheet conveying passage 111, the recording sheet P conveyed in the sheet conveying passage 111 is pressed and clamped by the intermediate transferring belt 124 and the secondary transferring roller 113, and a transfer bias is applied by the secondary transferring roller 113, so that the toner image on the intermediate transferring belt 124 is transferred onto the recording sheet P. The secondary transferring roller 113 is accommodated in the apparatus main body 11 in a state of being supported by a supporting member.

The fixing section 13 is adapted to fix the toner image which is transferred to the recording sheet P at the nip portion between the intermediate transferring belt 124 and the secondary transferring roller 113 onto the recording sheet P. The fixing section 13 includes a heat roller 132 provided with an electric heating member as a heat source, a fixing roller 130 so arranged as to face the heat roller 132, a fixing belt 133 which extends between the fixing roller 130 and the heat roller 132, and a pressing roller 134 which is so arranged as to face the heat roller 132 through the fixing belt 133. The recording sheet P supplied to the fixing section 13 in a state where the toner image is transferred receives heat from the heat roller 132 while passing through between the pressing roller 134 and the fixing belt 133 at a high temperature and receives heat from the heat roller 132, so that the fixing processing is applied.

The recording sheet P which is applied with the fix processing passes through a sheet-discharging conveying passage 114 which extends from an upper portion of the fixing section 13, and then is discharged to a sheet-discharging tray 151 of the sheet discharging section 15 which is provided on the top of the apparatus main body 11.

The sheet storage section 14 includes a manual feeding tray 141 which is provided openably and closably on a right side wall of the apparatus main body 11 in FIG. 1, and a sheet tray 142 which is drawably mounted at a position under the exposure section 123 in the apparatus main body 11. The sheet tray 142 stores a stack of sheets.

The sheet tray 142 is configured to have a box-shaped body whose upper side is fully opened, and a sheet stack P1 consisting of a plurality of layered recording sheets P can be stored. An uppermost recording sheet P of the sheet stack P1 stored in the sheet tray 142 is picked up at its downstream end (left end in FIG. 1) on an upper surface and taken from the sheet stack P1 to be conveyed to the sheet conveying passage 111 by driving of the pickup roller 143 one after another. Then, the recording sheet P passes through the sheet conveying passage 111 by driving of the pair of conveying rollers 112 and is sent to the nip portion between the secondary transferring roller 113 and the intermediate transferring belt 124 in the image forming section 12.

Figure 4:
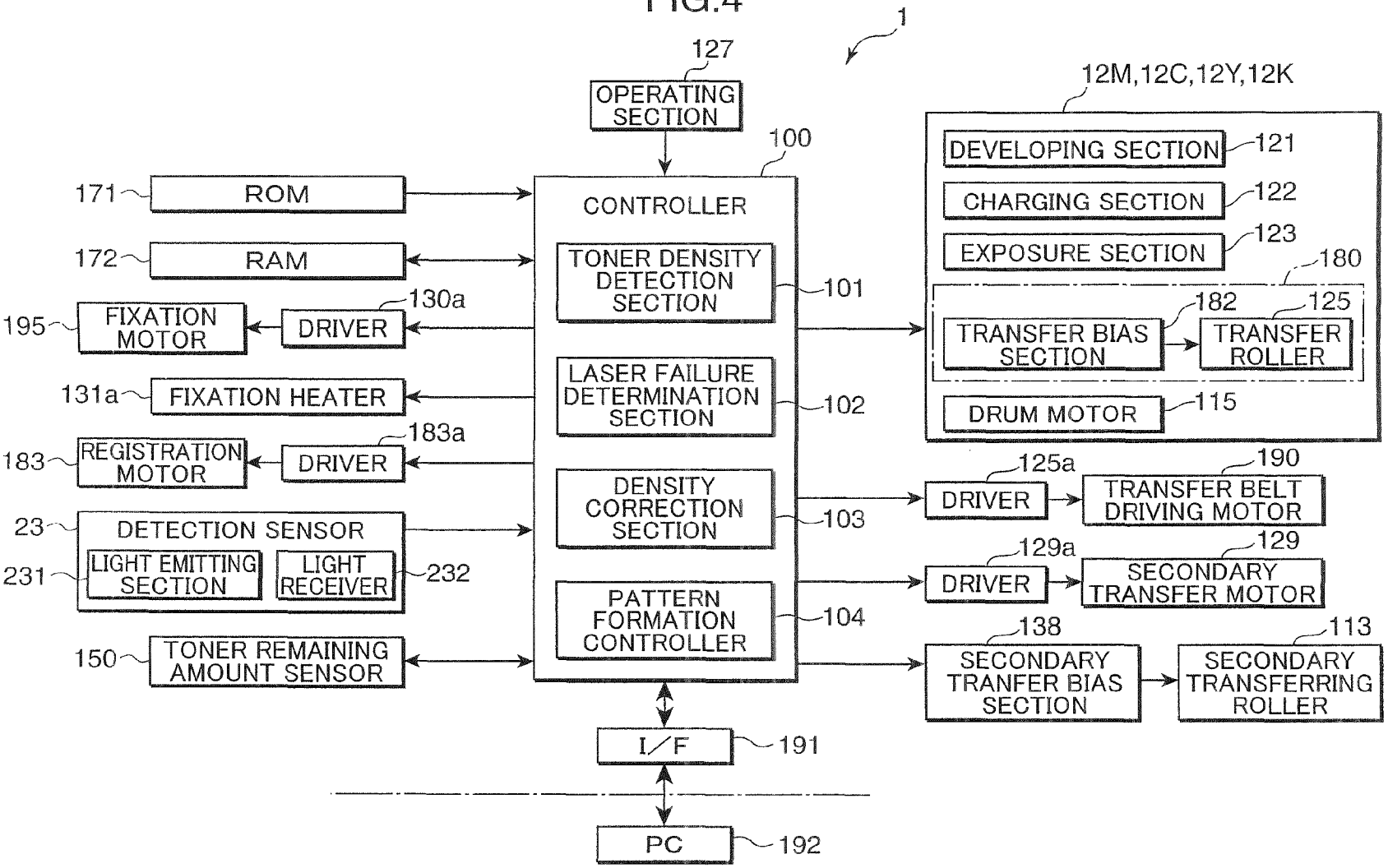
FIG. 4 is a block diagram showing an example of a schematic configuration of the printer.

Further, at a position facing the peripheral surface of the intermediate transferring belt 124 on a downstream side of the nip portion between the secondary transferring roller 113 and the intermediate transferring belt 124 in the running direction of the intermediate transferring belt 124, there are provided toner density detection sensors (density detection section) 23. The toner density detection sensors 23 are sensors which are adapted to detect a toner density on the peripheral surface of the intermediate transferring belt 124. The toner density detection sensors 23 are provided at different positions in a lengthwise direction (the direction of rotational axis) of the driving roller 124*a* of the intermediate transferring belt 124 (it is not intended to limit the number of parts of the toner density detection sensor 23 to be two). As shown in FIG. 2, the toner density detection sensors 23 are so provided as to be near opposite ends in the width direction of the intermediate transferring belt 124 (the lengthwise direction of the driving roller 124*a*) and are spaced apart by a predetermined clearance with respect to the peripheral surface of the intermediate transferring belt 124. As shown in FIG. 4 which will be described later, the toner density detection sensors 23 are electrically connected with a controller 100, and output a density of the detected toner pattern to the controller 100.

The toner density detection sensor 23, for example, has a configuration as described herebelow. As shown in FIG. 3, each toner density detection sensor 23 has a light emitting section 231 provided on one side in the running direction of the intermediate transferring belt 124 with respect to a suitable point p on the peripheral surface of the intermediate transferring belt 124, and a light receiver 232 provided on the other side. The light emitting section 231 includes a light source 2311 made up of an LED (Light Emitting Diode) or the like which is adapted to output a light to the point p on the peripheral surface of the intermediate transferring belt 124, a beam splitter 2312 which splits the light outputted from the light source 2311 into first and second polarization components, and a light receiving element 2313 which receives one polarization component of light from the beam splitter 2312. The first and second polarization components correspond to a P-wave (first polarization component) as a mirror-reflected light, and an S-wave (second polarization component) as a diffused light. The P-wave directly enters the peripheral surface of the intermediate transferring belt 124, and the S-wave comes out from the beam splitter 2312 and enters the light receiving element 2313.

The light source 2311 is tiled by an angle θ with respect to the peripheral surface of the intermediate transferring belt 124 and outputs a light including the P-wave and the S-wave with respect to the point p. The light receiving element 2313 is arranged to control the output operation of the light emitting section 231. A signal proportional to an irradiated light quantity is outputted from the light receiving element 2313 to a toner density detection section 101 (which will be described later) as a drive controller of the toner density detection sensor 23. The toner density detection section 101 controls the light outputted from the light source 2311 in such a manner that the output signal of the light receiving element 2313 always becomes constant.

The light receiver 232 includes a beam splitter 2321 which is adapted to split a light reflected from the peripheral surface of the intermediate transferring belt 124 into first and second polarization components, a first light receiving element 2322 which receives, a light of the first polarization component among the first polarization component (P-wave) and the second polarization component (S-wave) split by the beam splitter 2321, and a second light receiving element 2323 which receives a light of the second polarization component among the first and second polarization components.

The light emitted from the light emitting section 231 and reflected by the peripheral surface of the intermediate transferring belt 124 includes a mirror-reflected light which is at an angle close to the angle of incidence θ and the diffused light other than the mirror-reflected light. The ratio of the diffused light component increases in accordance with the amount of toner transferred onto the peripheral surface of the intermediate transferring belt 124, so that a ratio of the first and second polarization components of light received by the first and second light receiving elements 2322, 2323 changes.

The toner density detection sensor 23 utilizes this principle to output the output voltage corresponding to the ratio of the first and second polarization components of light received by the first and second light receiving elements 2322, 2323 to the toner density detection section 101. When there is no toner on the peripheral surface of the intermediate transferring belt 124, the first polarization component of light received by the first light receiving element 2322 becomes maximum, so that the output voltage becomes the maximum value. As the amount of toner on the peripheral surface of the intermediate transferring belt 124 increases, the light quantity of the first polarization decreases, so that the output voltage is lowered. The toner density detection section 101 calculates a density of toner adhered to the peripheral surface of the intermediate transferring belt 124 in accordance with the output voltage of the toner density detection sensor 23. It should be understood that the toner density detection sensor 23 and the toner density detection section 101 correspond to an example of the density detection section in claims.

At a position clamping the intermediate transferring belt 124 and facing the driven roller 124*b*, there is provided a cleaning roller (cleaning section) 35 for removing toner on the intermediate transferring belt 124.

FIG. 4 is a block diagram showing an example of a schematic configuration of the printer 1. The printer 1 includes the controller 100 which conducts an overall control to the printer 1. The controller 100 is connected with a ROM 171 storing an operation program for the whole apparatus, and a RAM 172 storing image data and the like temporarily and serving as a working area. Further, the controller 100 is also connected with the image forming units 12M, 12C, 12Y, 12K for respective colors, and the controller 100 controls the charging section 122, the exposure section 123, the developing section 121, a transfer bias section 182 which applies a transfer bias to the primary transfer roller 125 to transfer the toner image formed on the photosensitive drum 120 onto the recording sheet, and the drum motor 115 which is a drive power source for the photosensitive drum 120, provided in each of the image forming units 12M, 12C, 12Y, 12K. The primary transfer roller 125 and the transfer bias section 182 serve as a transfer section 180.

Further, the aforementioned toner density detection sensors 23 (the light emitting section 231 and the light receiver 232) are also connected with the controller 100. The toner density detection sensors 23 output a detection signal indicating a density of toner pattern subjected to detection to the controller 100.

Further, the printer 1 includes a toner remaining amount detection sensor (toner remaining amount detector) 150 which detects the toner remaining amount in a toner container (toner accumulation section) which supplies toner to the developing section 121 and which is also connected to the controller 100. The toner remaining amount detection sensor 150 is provided in each toner container provided in each of the image forming units 12M, 12C, 12Y, 12K, and is made up of a light sensor which detects, for example, a height of mass of toner stored in the toner container. The light sensor includes a light emitting section provided on one side wall in the toner container and a light receiver provided on the other side wall, and is attached at a height position indicating that toner is not stored in the toner container. Then, the light sensor emits a signal indicating that toner is not stored in the toner container to the controller 100 based on that a light emitted from the light emitting section is received by the light receiver without being interrupted by mass of toners. It should be noted that the remaining amount of toner in the state where toner is not stored in the toner container is an example of the predetermined toner remaining amount in claims.

Further, the controller 100 serves also as the toner density detection section 101, the laser failure determination section 102, the density correction section 103, and the pattern formation controller 104.

The toner density detection section (density detection section) 101 controls driving of the toner density detection sensors 23 and detects densities of toner patterns (toner images) for calibration processing transferred by the image forming units 12M, 12C, 12Y, 12K to the intermediate transferring belt 124.

The laser failure determination section 102 determines whether or not any of the light sources 2311 for the exposure sections provided respectively in the image forming unit 12M, 12C, 12Y, 12K has a failure. Details of the failure determination processing for the light sources by the laser failure determination section 102 will be described later.

If a density of the toner pattern detected by the toner density detection sensors 23 does not satisfy a predetermined condition, the density correction section 103 performs toner density adjustment by adjusting an output characteristic. As the calibration processing, for example, the density correction section 103 adjusts a developing bias value of the developing equipment in accordance with the toner density of the toner pattern formed on the intermediate transferring belt 124.

The pattern formation controller 104 performs processing and control necessary for allowing the image forming units 12M, 12C, 12Y, 12K for respective colors to form the toner patterns.

A fixation motor 195 drives the heat roller 130 and the pressing roller 134. The fixation motor 195 is controlled by the controller 100 through a driver 130*a*. A fixation heater 131*a* is provided in the heat roller 130 and controlled to be turned ON and OFF by the controller 100.

In FIG. 4, the image forming units for magenta, cyan, yellow, and black are collectively shown as one image forming unit. However, the image forming units for respective colors are connected to the controller 100.

Further, a transfer belt driving motor 190 is a drive power source for the driving roller which allows the intermediate transferring belt 124 to run and is controlled by the controller 100 through a driver 125*a*.

An operating section 127 includes an operation panel for receiving various operation instructions from a user and the aforementioned display section. Further, the controller 100 is connected with the PC (personal computer) 192 through an interface 191. The printer 1 performs image forming based on image data inputted from the PC 192.

The registration motor 183 is adapted to rotationally drive an unillustrated registration roller and controlled by the controller 100 through a driver 183*a*.

A secondary transfer motor 129 is adapted to rotationally drive the secondary transferring roller 113 (FIG. 1) and controlled by the controller 100 through a driver 129*a*.

Further, the controller 100 is connected with a secondary transfer bias section 138 which applies a transfer bias to the secondary transferring roller 113.

Figure 5:
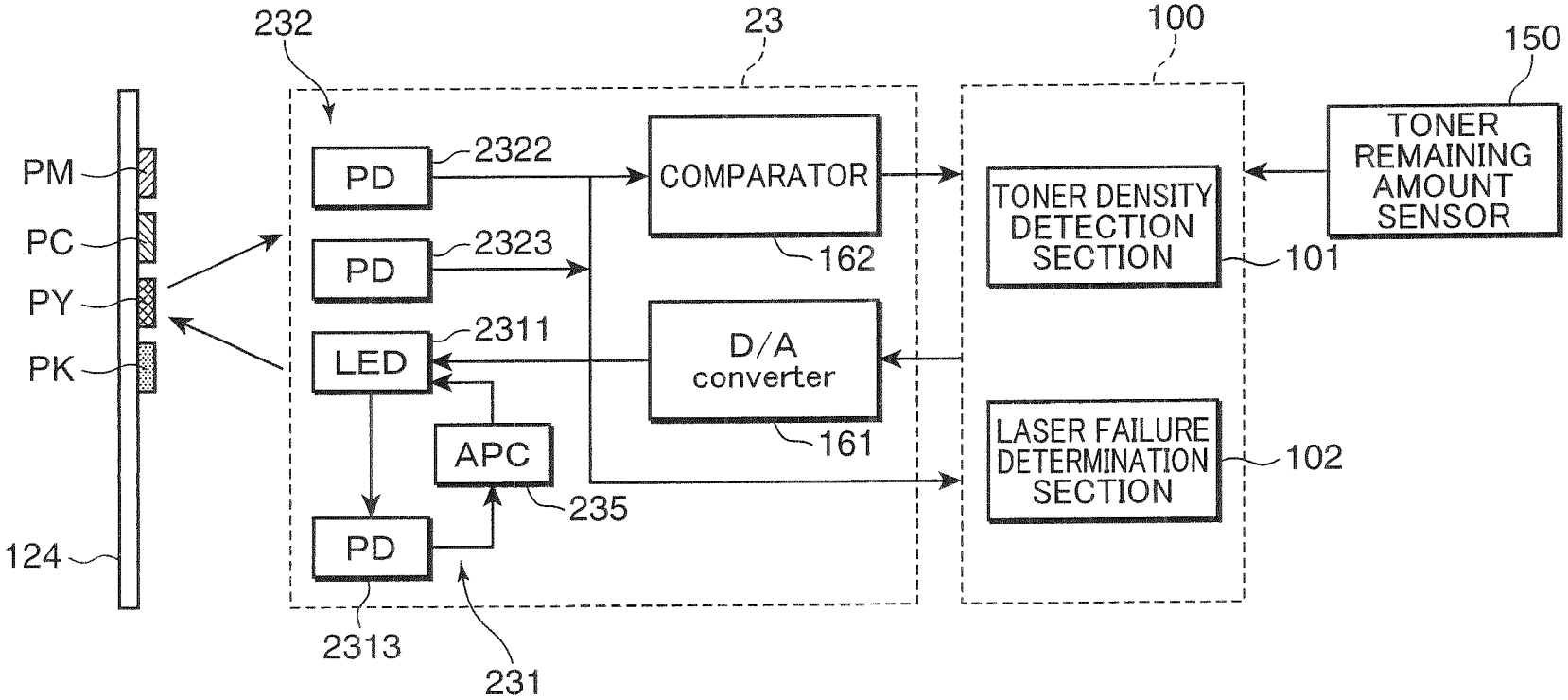
FIG. 5 shows a schematic configuration of the toner density detection sensor and a control mechanism portion thereof.
Figure 6:
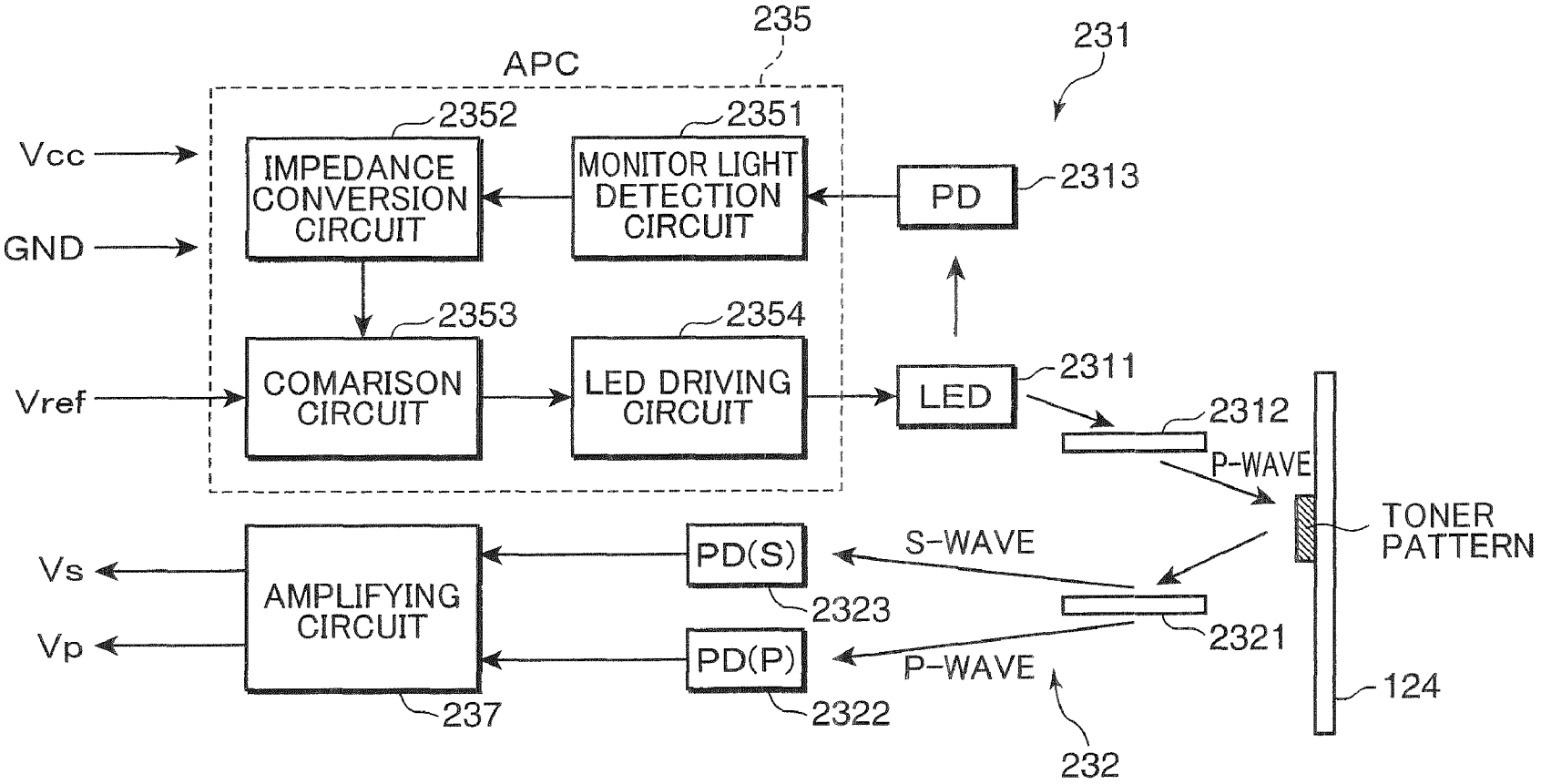
FIG. 6 shows a schematic configuration of the toner density detection sensor.

Next, a control mechanism for the toner density detection sensors 23 will be described in detail. FIG. 5 shows a schematic configuration of the toner density detection sensor 23 and a control mechanism portion for the same. FIG. 6 shows a schematic configuration of the toner density detection sensor.

As shown in FIG. 5, the toner density detection sensor 23 includes the light emitting section 231 and the light receiver 232. The light emitting section 231 has the light source 2311. The light source 2311 is driven by a control signal outputted from the toner density detection section 101 of the controller 100 through a D/A converter 161. An automatic power control circuit (hereinafter, referred to as "APC circuit") 235 controls the bias voltage such that the light quantity of a laser light beam emitted from the light source 2311 in accordance with an electric signal acquired from a photodiode (PD) 2313 becomes constant.

The light receiver 232 includes a first light receiving element 2322 and a second light receiving element 2323, each of those being made up of a photodiode (PD). A comparator circuit 162 takes difference between the first and second polarization components received by the first and second light receiving elements 2322, 2323 (difference between the P-wave output voltage and the S-wave output voltage), and the comparator circuit 162 outputs the difference to the controller 100.

In the controller 100, based on the difference acquired from the comparator circuit 162, the toner density detection section 101 detects a toner pattern density, and the laser failure determination section 102 performs failure determination for the light source 2311.

The configuration of the toner density detection sensor 23 will be further described. As shown in FIG. 6, the APC circuit 235 of the light emitting section 231 includes a monitor light detection circuit 2351, an impedance conversion circuit 2352, a comparison circuit 2353, and an LED driving circuit 2354.

The monitor light detection circuit 2351 detects an emitted light quantity of the light source 2311 based on an electric signal acquired from the photodiode 2313. The comparison circuit 2353 performs adjustment such that a light quantity control signal outputted to the LED driving circuit 2354 shows a predetermined constant light quantity, based on a signal indicating an emitted light quantity acquired from the monitor light detection circuit 2351 through the impedance conversion circuit 2352 and a value of a reference light quantity. The LED driving circuit 2354 drives the light source 2311 based on the adjusted light quantity control signal.

The light receiver 232 performs a photoelectric conversion by means of the amplifying circuit 237 with respect to an electric signal outputted from the first light receiving element 2322 which receives the P-wave split by the beam splitter 2321 and an electric signal outputted from the second light receiving element 2323 which receives the S-wave, and each of the amplified electric signals is inputted to the comparator circuit 162.

In FIG. 5, it is so depicted that the toner density detection sensor 23 includes the comparator circuit 162 and the D/A converter 161. However, it may be so configured that the toner density detection section 101 of the control circuit 100 includes the comparator circuit 162 and the D/A converter 161. Or, it may be so configured that the comparator circuit 162 and the D/A converter 161 are provided in the control circuit 100, and the toner density detection section 101 may perform communication of signals with the toner density detection sensor 23 through the comparator circuit 162 and the D/A converter 161.

Figure 7:
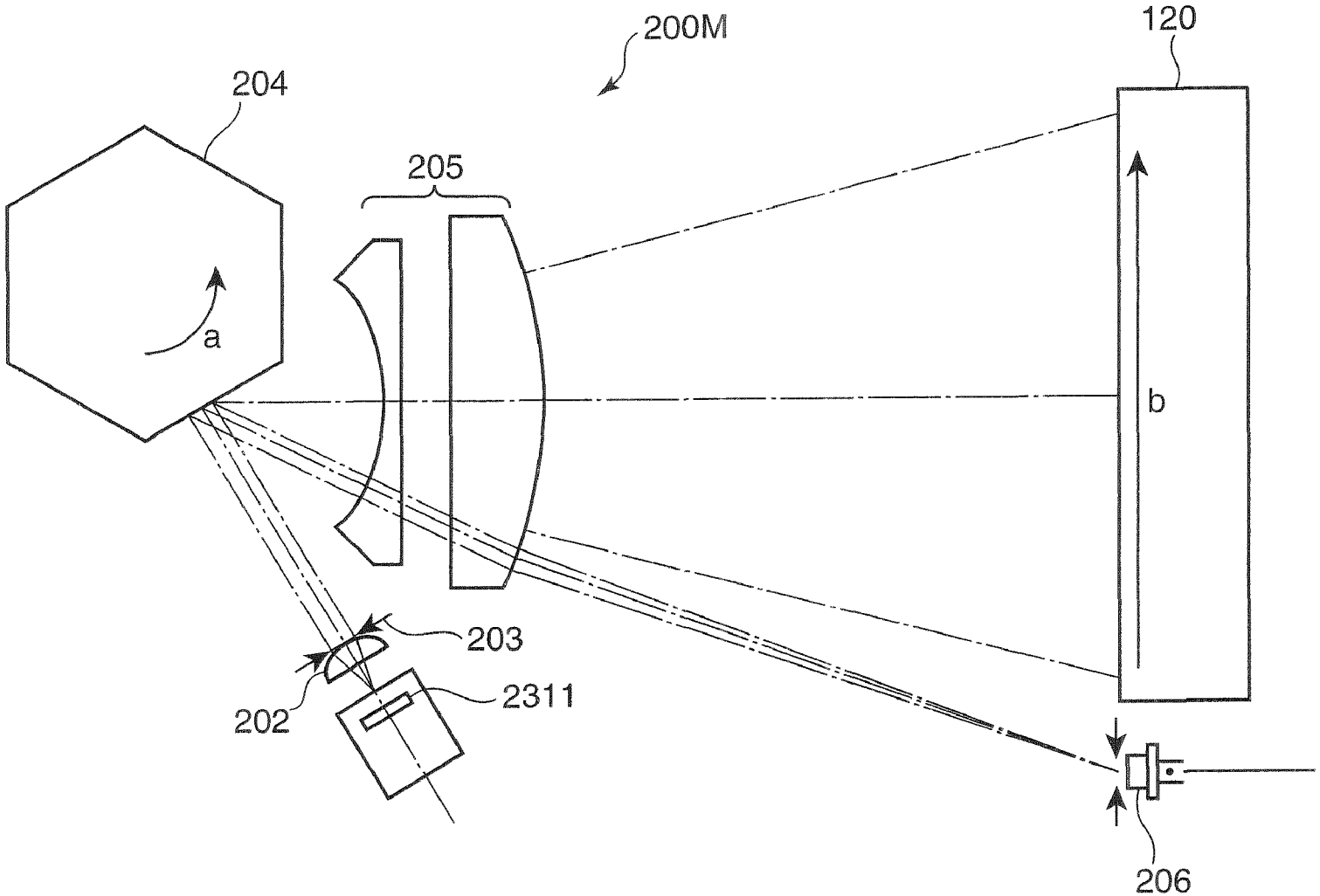
FIG. 7 schematically shows a mechanical configuration of a laser scanner provided in an exposure section.

FIG. 7 schematically shows a mechanical configuration of a laser scanner provided in the exposure section 123. Laser scanning units (LSU) provided respectively in the exposure sections 123 for the image forming units 12M, 12C, 12Y, 12K have the same configuration unless being especially described. Therefore, only a laser scanning unit 200M for the image forming unit 12M will be described hereinafter, and description regarding the laser scanning units for the other image forming units will be omitted.

The laser scanning unit 200M includes the light source 2311 made up of a laser diode (LD) and the like, a collimator lens 202, an aperture 203, a rotating multifaceted mirror (light deflector) 204, and an f-θ lens 205.

A laser light emitted from the light source 2311 is formed to be a parallel light by the collimator lens 202 and the aperture 203, and the parallel light enters the rotating multifaceted mirror 204 with a predetermined beam diameter. The rotating multifaceted mirror 204 rotates in the direction of an arrow "a" at a constant speed. The rotation of the rotating multifaceted mirror 204 causes the incident light to be a deflected beam which changes angle continuously. The laser light as the deflected beam is collected by the f-θ lens 205. However, since the f-θ lens 205 performs correction so as to maintain temporal linearity in scanning, the deflected beam scans in the direction of an arrow "b" on the photosensitive drum 120 as an image bearing member at a constant speed.

Further, the deflected beam reflected by the rotating multifaceted mirror 204 enters also to a BD sensor (light detector) 206 through the f-θ lens 205. The BD sensor 206 is a sensor which is adapted to detect a reflected light from the rotating multifaceted mirror 204, and the detection signal of the BD sensor 206 is used as a synchronizing signal for synchronizing rotation of the rotating multifaceted mirror 204 and timing to start writing data.

In the present embodiment, the BD sensor 206 is provided in each of the image forming unit 12M and the image forming unit 12Y among the image forming units 12M, 12C, 12Y, 12K.

Figure 8:
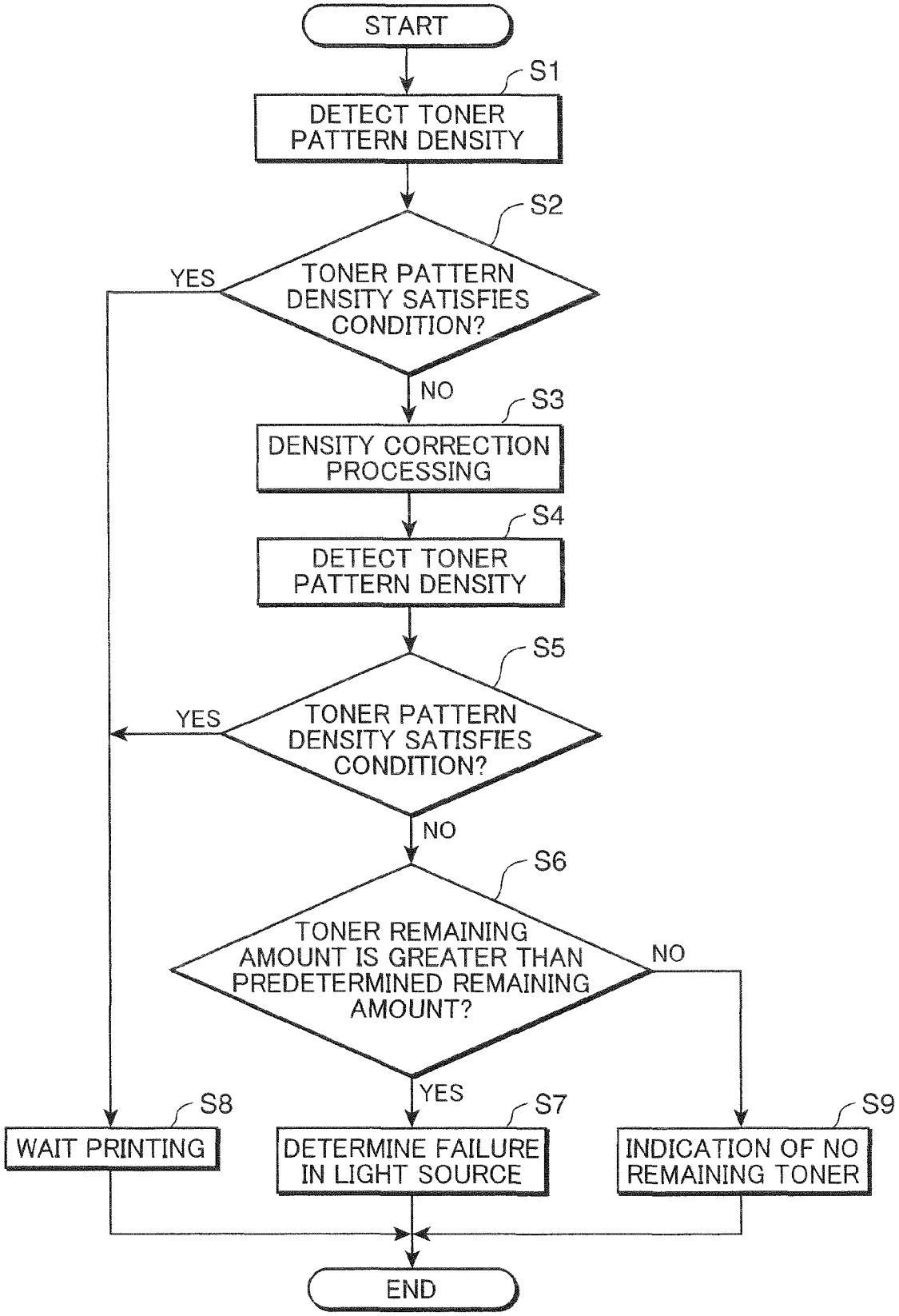
FIG. 8 is a flowchart showing a first embodiment of a failure determination processing executed by the printer to determine failure in the light source of the exposure section.

Next, a first embodiment of the failure determination processing executed by the printer 1 to determine failure in the light source 2311 of the exposure section 123 will be described. FIG. 8 is a flowchart showing the first embodiment of the failure determination processing executed by the printer to determine failure in the light source 2311 of the exposure section 123. The failure determination processing is executed with respect to the image forming units 12C, 12K which are not provided with the BD sensor 206.

In the printer 1, at each time when a power of the printer 1 is turned on or an elapse of a predetermined time period after the power of the printer 1 is turned on, the pattern formation controller 104 allows the image forming units 12C, 12K for respective colors to form the aforementioned toner patterns on the intermediate transferring belt 124, and the toner density detection section 101 drives the toner density detection sensors 23 to detect densities of the toner patterns based on signals acquired from the toner density detection sensors 23 (S1). Here, the density correction section 103 determines whether the densities of the toner patterns detected by the toner density detection sensors 23 satisfies a predetermined condition (S2). If the densities of the toner patterns satisfies the predetermined condition (YES in S2), the calibration processing is not executed, and the controller 100 permits image forming to be performed by the image forming section 12 and shifts the printer 1 to fall in a print-waiting state (S8).

Figure 9:
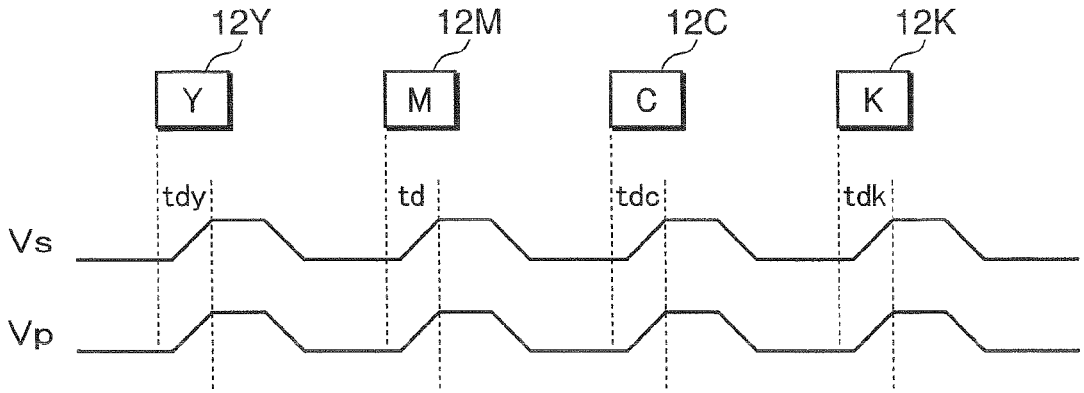
FIG. 9 shows respective waveforms of the P-wave output voltage (Vp) and S-wave output voltage (Vs).
Figure 10:
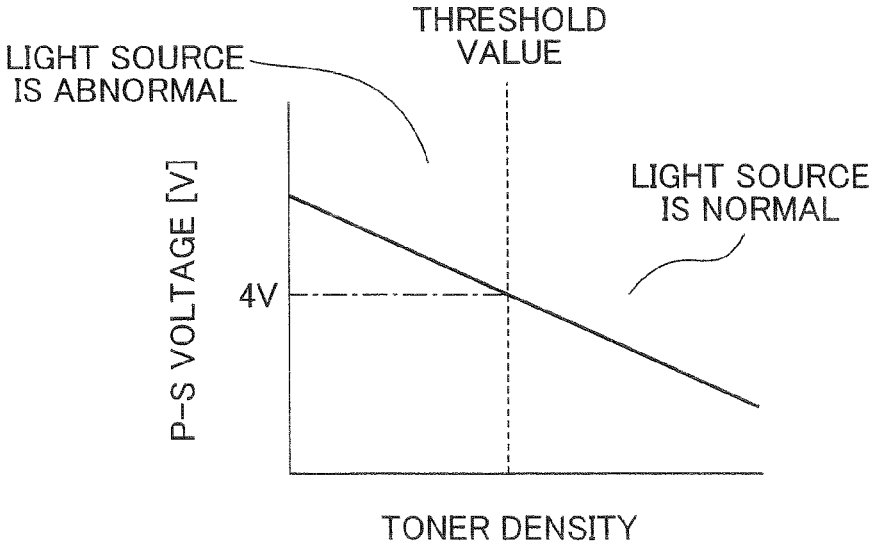
FIG. 10 shows a relationship between a toner pattern density and a difference between the P-wave output voltage (Vp) and S-wave output voltage (Vs).

In the present embodiment, as the densities of the toner patterns, difference between the P-wave output voltage (Vp) and the S-wave output voltage (Vs) shown in FIG. 9 is calculated. Then, a threshold value is set to the difference. As shown in FIG. 10, when the density of the toner pattern is lowered, a reflectance of a light irradiated from the toner density detection sensor 23 and reflected from the toner patterns on the intermediate transferring belt 124 is lowered. In other words, the S-wave output voltage of diffusely reflected light is lowered, and the P-wave output voltage of the mirror reflected light rises, so that the difference between the P-wave output voltage and the S-wave output voltage becomes large. On the contrary, if the toner density rises, the difference becomes small.

For example, a threshold value of the difference between the P-wave output voltage and the S-wave output voltage is set to be 4V (FIG. 10). When the light source 2311 fails due to electric stress or life duration, causing the density of the toner pattern on the intermediate transferring belt 124 to thereby making the difference between the P-wave output voltage and the S-wave output voltage be large, the set value becomes greater than the threshold value (4V). In the present embodiment, the case where the difference becomes greater than the threshold value is described as the case where the density of the toner pattern does not satisfy the predetermined condition.

On the other hand, if the density of the toner pattern does not satisfy the condition (NO in S2), the density correction section 103 executes the density correction processing (S3). Then, after the density correction processing is executed, the pattern formation controller 104 allows the image forming unit which has formed the toner density pattern having the density not satisfying the condition to form the toner pattern on the intermediate transferring belt 124 again as shown in FIG. 2, and the toner density detection section 101 detects the density of the toner pattern again (S4). If the density correction section 103 determines that the density of the toner pattern detected again by the toner density detection sensor 23 satisfies the condition after the density correction processing satisfies the condition (YES in S5), the controller 100 allows the printer 1 to shift to the print waiting state (S8).

If the density correction section 103 determines that the density of the toner pattern detected again by the toner density detection sensor 23 after the density correction processing is executed does not satisfy the condition (NO in S5), the laser failure determination section (determination section) 102 acquires a toner remaining amount detection value regarding the image forming unit, which is subjected to the toner pattern formation and the toner pattern density detection, from the toner remaining amount detection sensor 150, and determines whether the toner remaining amount is greater than the predetermined remaining amount (S6). Then, if the toner remaining amount is greater than the predetermined remaining amount (YES in S6), the laser failure determination section 102 determines failure in the light source 2311 of the exposure section 123 provided in the image forming unit (S7). In other words, if the density correction section 103 determines that the density of the toner pattern after the calibration processing is greater than the predetermined threshold value, and the toner remaining amount detected by the toner remaining amount detection sensor 150 is greater than the predetermined remaining amount, the laser failure determination section 102 determines that the light source 2311 of the exposure section 123 in the image forming unit is in failure.

On the other hand, if the toner remaining amount is not greater than the predetermined remaining amount (NO in S6), the laser failure determination section 102 determines that the light source 2311 of the exposure section 123 of the image forming unit is not in failure, and the controller 100 allows the display section of the operating section 127 to display indication that there is no toner remaining in the toner container of the image forming unit (S9).

Figure 11:
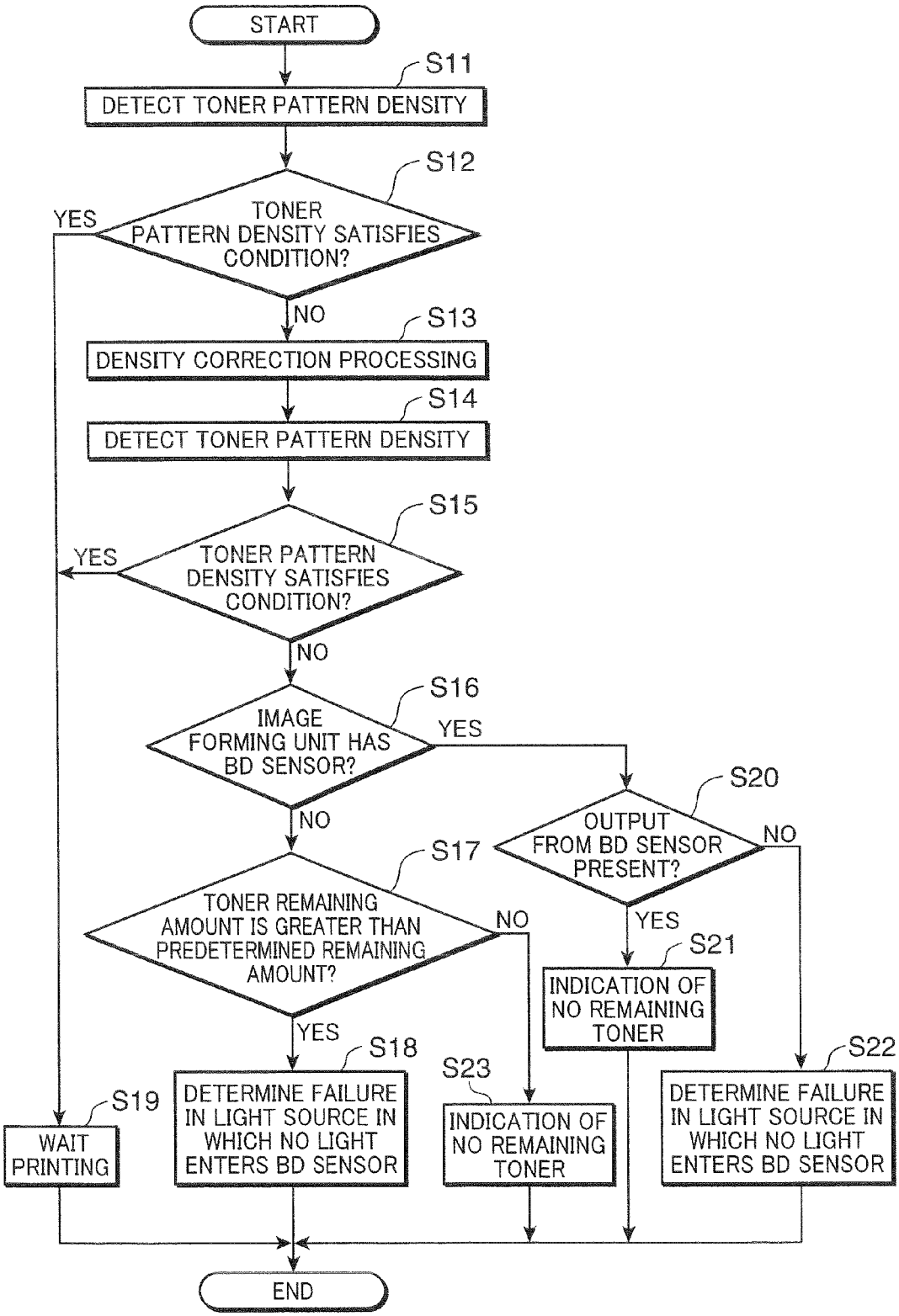
FIG. 11 is a flowchart showing a second embodiment of a failure determination processing executed by the printer to determine failure in the light source of the exposure portion.

Next, a second embodiment of the failure determination processing executed by the printer 1 to determine failure in the light source 2311 of the exposure section 123 will be described. FIG. 11 is a flowchart showing the second embodiment of the failure determination processing executed by the printer 1 to determine failure in the light source 2311 of the exposure section 123. The failure determination processing is executed with respect to the image forming units 12M, 12C, 12Y, 12K for respective colors. Description regarding the processing which is similar to the first embodiment will be omitted.

In the printer 1, at each time when a power of the printer 1 is turned on or an elapse of a predetermined time period after the power of the printer 1 is turned on, the pattern formation controller 104 allows the image forming units 12M, 12C, 12Y, 12K for respective colors to form the aforementioned toner patterns on the intermediate transferring belt 124, and the toner density detection section 101 drives the toner density detection sensors 23 to detect densities of the toner patterns based on signals acquired from the toner density detection sensors 23 (S11).

If any image forming unit which is so determined that the toner pattern density does not satisfy the predetermined condition (NO in S15) in the toner pattern density detection after the density correction processing (S13), the laser failure determination section 102 determines that the image forming unit which is so determined that the toner pattern density does not satisfy the predetermined condition is an image forming unit which is provided with a BD sensor 206 (S16). The laser failure determination section 102 has information as to whether each of the image forming units 12M, 12C, 12Y, 12K includes the BD sensor 206. If the laser failure determination section 102 determines that the image forming unit is an image forming unit provided with the BD sensor 206 (YES in S16), and there is any output from the BD sensor 206 (YES in S20), the laser failure determination section 102 determines that the light source 2311 of the exposure section 123 provided in the image forming unit is not in failure, and the controller 100 controls the display section of the operating section 127 to display indication that there is no toner remaining in the toner container of the image forming unit (S21). If there is no output from the BD sensor 206 (NO in S20), it is determined that the light source 2311 of the exposure section 123 provided in the image forming unit is in failure (S22).

On the other hand, if the image forming unit which is determined that the toner pattern density does not satisfy the condition is an image forming unit which is not provided with the BD sensor 206 (NO in S16), and the toner remaining amount detected by the toner remaining amount detection sensor 150 is greater than the predetermined toner remaining amount (YES in S17), the laser failure determination section 102 determines that the light source 2311 of the exposure section 123 determines failure (S18). If the toner remaining amount detected by the toner remaining amount detection sensor 150 is not greater than the predetermined toner remaining amount (NO in S17), the laser failure determination section 102 determines that the light source 2311 of the exposure section 123 of the image forming unit is not in failure, and the controller 100 controls the display section of the operating section 127 to display indication that toner is not remaining in the toner container of the image forming unit (S23).

The present invention is not limited to the configurations of the embodiments, and it can be modified in various manners. For example, in the embodiments, the failure determination processing as to the light source 2311 of the exposure section 123 in the printer 1 provided with the image forming units 12M, 12C, 12Y, 12K for respective colors for color image forming are shown. However, the present invention can be also applied to a printer for monochromatic printing or color printing, having a plurality of light sources in an exposure section of one image forming unit, and performing high-speed latent image forming processing with use of light beams emitted from a plurality of light sources. As described above, in an exposure section having a plurality of light sources, for example, the BD sensor 206 is provided for two light sources, for the purpose of cost reduction, and there is a case where only a light beam from one light source enters the BD sensor 206. In the aforementioned printer, for example, one rotating multifaceted mirror 204 allows the light outputted from the first and second light sources to scan on the photosensitive drum, and the BD sensor 206 detects a light outputted from a light source of any one of the first and second light sources and outputs a horizontal synchronizing signal.

According to the failure determination processing for determining failure in the light source 2311 which will be described herebelow, for example, in the case where only one BD sensor 205 is provided for two light sources, and the exposure section has a configuration in which only a light beam from one light source enters the BD sensor 206, it is determined whether failure occurs in a light source in which a light beam does not enter the BD sensor 206.

Figure 12:
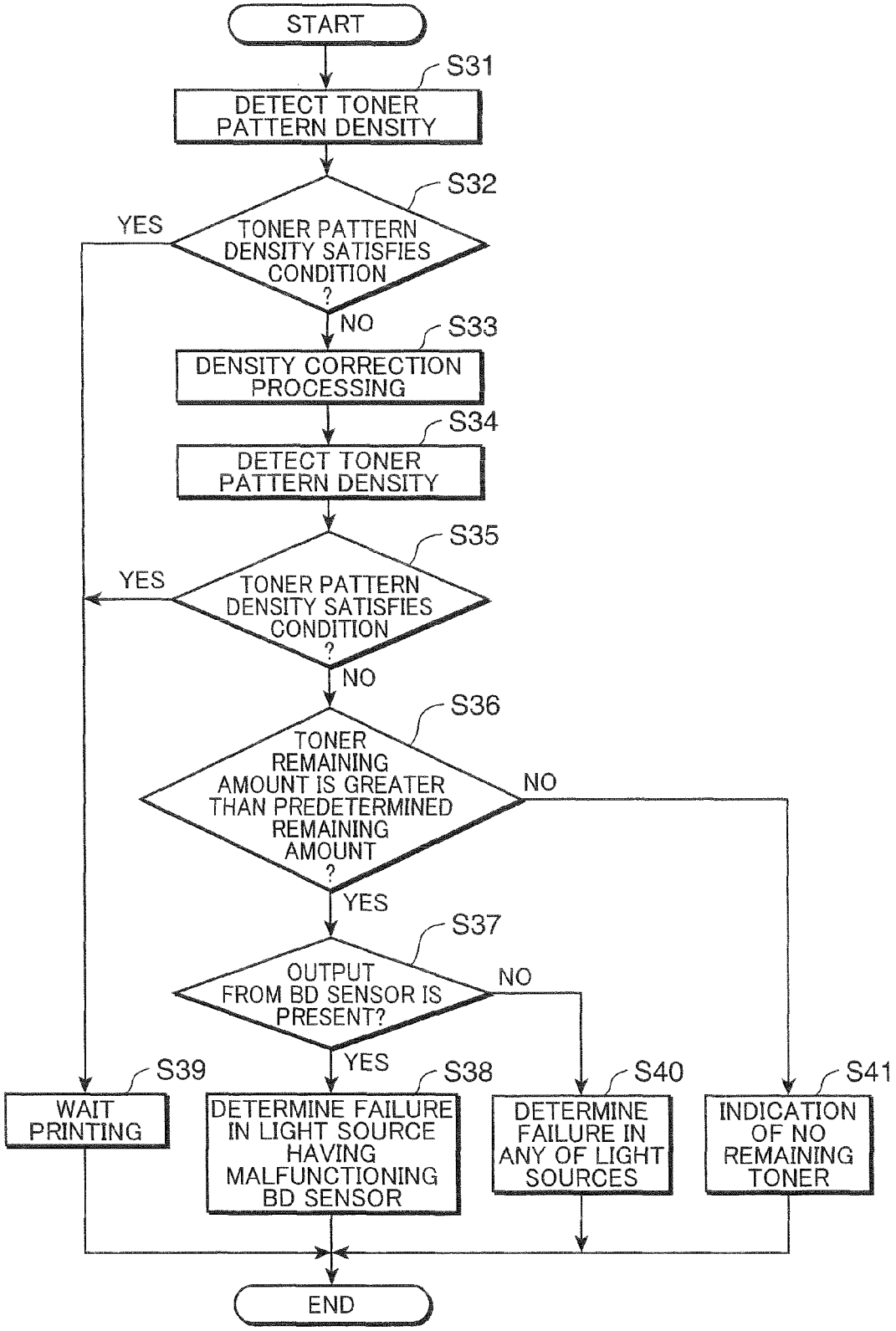
FIG. 12 is a flowchart showing a failure determination processing executed by a printer, which adopts a mechanism of simultaneously scanning a plurality of lines with use of light beams emitted from two light sources in one exposure section, to determine failure in a light source of the printer.

The failure determination processing executed by the printer to determine failure in the light source 2311 of the exposure section will be described. FIG. 12 is a flowchart showing the failure determination processing executed by the printer, which adopts a mechanism of simultaneously scanning a plurality of light at one exposure section with use of light beams from two light sources, to determine failure in the light source 2311. Description regarding the processing which is similar to that of the first and second embodiments will be omitted.

In the printer 1, at each time when a power of the printer 1 is turned on or an elapse of a predetermined time period after the power of the printer 1 is turned on, the pattern formation controller 104 allows the image forming unit to form the aforementioned toner pattern on the intermediate transferring belt 124, and the toner density detection section 101 drives the toner density detection sensor 23 to detect the density of the toner pattern based on a signal acquired from the toner density detection sensor 23 (S31).

Then, if the density correction section 103 determines that the toner pattern density after the density correction processing (S33) does not satisfy the predetermined condition (NO in S35), and the toner remaining amount detected by the toner remaining amount detection sensor 150 is greater than the predetermined toner remaining amount (YES in S36), and there is an output from the BD sensor 206 (YES in S37) the laser failure determination section 102 determines that a failure occurs in the light source in which a light beam does not enter the BD sensor 206 (S38). On the other hand, if there is no output from the BD sensor 206 (NO in S37), the laser failure determination section 102 determines that a failure occurs in at least a light source in which a light beam enters the BD sensor 206, among the two light sources provided in the exposure section (S40).

The present invention is not limited to the configuration of the embodiment, and it can be modified in various manners. The configurations and settings of the embodiments shown in FIGS. 1-12 are mere examples, and it is not intended to limit the present invention to the embodiments.

(1) In summary, according to an aspect of the present invention, an image forming apparatus includes: a photosensitive member having a surface to which a latent image is formed; a charging section which charges the surface of the photosensitive member; an exposure section which irradiates a light onto the surface of the photosensitive drum charged by the charging section to form the latent image; a developing section which supplies toner onto the latent image formed on the surface of the photosensitive member to form a toner image; an intermediate transfer member to which the toner image formed on the surface of the photosensitive member is transferred; a transfer section which transfers the toner image onto the intermediate transfer member; a density detection section which detects a density of the toner image transferred to the intermediate transfer member; a density correction section which executes density correction processing of the toner image forming in a case where a density value detected by the density detection section does not satisfy a predetermined condition; a toner remaining amount detector which detects a toner remaining amount of a toner accumulation section which supplies toner to the developing section; and a determination section which determines that failure has occurred in the exposure section if the density value detected by the density detection section does not satisfy the predetermined condition after the density correction processing by the density correction section is terminated, and the toner remaining amount detected by the toner remaining amount detector is greater than a predetermined remaining amount.

According to the present invention, the determination section determines failure in the exposure section, based on the density value detected by the density detection section after the density correction processing executed by the density correction section and the toner remaining amount detected by the toner remaining amount detector. Therefore, failure in the light source can be detected even in the light source for the exposure with respect to the photosensitive member where a light does not enter the light detection mechanism which outputs a horizontal synchronizing signal. Further, when a failure in the exposure section occurs due to malfunctioning in the light source, such effect appears in the density value detected by the density detection section. Therefore, accurate failure determination in the exposure section is possible based on whether or not the density value detected by the density detection section after the density correction processing executed by the density correction section satisfies a predetermined condition. Further, by setting the failure determination condition in the exposure section based on that the toner remaining amount detected by the toner remaining amount detector is greater than the predetermined toner remaining amount, accuracy in failure determination for the exposure section is improved by not determining failure in the exposure section in the case where an error occurs in the detected density value in the density detection section due to lack of toner.

Therefore, according to the present invention, as to the exposure section in the image forming apparatus, presence or absence of failure in the light source can be detected accurately even if the light source is so set that a light does not enter the light detector which outputs a horizontal synchronizing signal.

(2) Further, according to an aspect of the present invention, image forming units each including the photosensitive member, the charging section, the exposure section, the developing section, and the transfer section are provided for respective colors for color image forming, and the exposure section includes: a light source which outputs a light beam; and a light deflector allows the light beam outputted from the light source to scan on the surface of the photosensitive member to form the latent image, and at least one of the image forming units for the respective colors further includes a light detector which detects the light beam outputted from the light source and outputs a horizontal synchronizing signal, and if the density value detected by the density detection section does not satisfy the predetermined condition after the density correction processing is executed by the density correction section for each of the image forming units for respective colors, and there is the image forming unit in which the toner remaining amount detected by the toner remaining amount detector is greater than the predetermined remaining amount, the determination section determines that failure has occurred in the light source of the image forming unit under a condition that the image forming unit is not subjected to the light detection executed by the light detector.

(3) Further, according to an aspect of the present invention, if the density value detected by the density detection section does not satisfy the predetermined condition after the density correction processing is performed by the density correction section for each of the image forming units for respective colors, and the image forming unit is provided with the light detector, the determination section determines that failure has occurred in the light source of the image forming unit if the light detection is not executed by the light detector, or determines that the toner remaining amount in the toner accumulation section is equal to or less than the predetermined remaining amount if the light detection is executed by the light detector.

According to this invention, the image forming units are provided for respective colors for color image forming, and in the case where the light detector is provided only for the exposure section in any of the image forming units, by setting non-provision of the light detector as the failure determination condition, it can avoid a situation that the light source of the exposure section is determined as being in failure regardless of that there is an output signal from the exposure section provided with the light detector.

(4) Further, according to an aspect of the present invention, the exposure section includes: a first light source which outputs a first light beam; a second light source which outputs a second light beam; a light deflector which allows the light beam outputted from the first and second light sources to scan on the photosensitive member surface; and a light detector which detects the light beam outputted from either one of the first and second light sources and outputs a horizontal synchronizing signal, and if the density value detected by the density detection section does not satisfy the predetermined condition after the density correction processing executed by the density correction section is terminated, and the toner remaining amount detected by the toner remaining amount detector is greater than the predetermined remaining amount, and if the horizontal synchronizing signal is outputted from the light detector, the determination section determines that failure has occurred in the light source, among the first and the second light sources, which is not subjected to the light detection executed by the light detector.

According to this aspect of the invention, the exposure section includes first and second light sources, and in the case where it is so set that a light emitted from one of the light sources does not enter the light detector, failure in the light source, among the first and second light source, which is not subjected to the light detection by the light detector can be determined accurately by adding presence or absence of an output of a horizontal synchronizing signal from the light detector as condition for failure determination in the exposure section.

(5) Further, according to an aspect of the present invention, if the density value detected by the density detection section does not satisfy the predetermined condition after the density correction processing executed by the density correction section is terminated, and the toner remaining amount detected by the toner remaining amount detector is greater than the predetermined remaining amount, and if the horizontal synchronizing signal is not outputted from the light detector, the determination section determines that failure has occurred in at least the light source subjected to the light detection by the light detector among the first and second light sources.

According to this aspect of the invention, in the case where the density value detected by the density detection section after the density correction processing does not satisfy the predetermined condition, and the toner remaining amount is greater than the predetermined remaining amount, and the horizontal synchronizing signal is not outputted from the light detector, it is determined that, among the first and second light sources, at least one of the light sources at least subjected to the light detection by the light detector has a failure. Therefore, accuracy in detecting occurrence of the failure in each light source can be improved.

This application is based on Japanese Patent application serial No. 2008-135329 filed in Japan Patent Office on May 23, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

a photosensitive member having a surface to which a latent image is formed;

a charging section which charges the surface of the photosensitive member;

an exposure section which irradiates a light onto the surface of the photosensitive member charged by the charging section to form the latent image;

a developing section which supplies toner onto the latent image formed on the surface of the photosensitive member to form a toner image;

an intermediate transfer member to which the toner image formed on the surface of the photosensitive member is transferred;

a transfer section which transfers the toner image onto the intermediate transfer member;

a density detection section which detects a density of the toner image transferred to the intermediate transfer member;

a density correction section which executes density correction processing of the toner image forming in a case where a density value detected by the density detection section does not satisfy a predetermined condition;

a toner accumulation section that supplies toner to the developing section;

a toner remaining amount detector which detects a toner remaining amount of the toner accumulation section; and a determination section which determines that failure has occurred in the exposure section if the density value detected by the density detection section does not satisfy the predetermined condition after the density correction processing by the density correction section is terminated and the toner remaining amount detected by the toner remaining amount detector is greater than a predetermined remaining amount.

2. The image forming apparatus according to claim 1, wherein the toner accumulation section is a toner container.

3. The image forming apparatus according to claim 1, wherein image forming units each including the photosensitive member, the charging section, the exposure section, the developing section, and the transfer section are provided for respective colors for color image forming, and the exposure section includes: a light source which outputs a light beam; and a light deflector allows the light beam outputted from the light source to scan on the surface of the photosensitive member to form the latent image, and at least one of the image forming units for the respective colors further includes a light detector which detects the light beam outputted from the light source and outputs a horizontal synchronizing signal, and if the density value detected by the density detection section does not satisfy the predetermined condition after the density correction processing is executed by the density correction section for each of the image forming units for respective colors, and there is the image forming unit in which the toner remaining amount detected by the toner remaining amount detector is greater than the predetermined remaining amount, the determination section determines that failure has occurred in the light source of the image forming unit under a condition that the image forming unit is not subjected to the light detection executed by the light detector.

4. The image forming apparatus according to claim 3, wherein if the density value detected by the density detection section does not satisfy the predetermined condition after the density correction processing is performed by the density correction section for each of the image forming units for respective colors, and the image forming unit is provided with the light detector, the determination section determines that failure has occurred in the light source of the image forming unit if the light detection is not executed by the light detector, or determines that the toner remaining amount in the toner accumulation section is equal to or less than the predetermined remaining amount if the light detection is executed by the light detector.

5. The image forming apparatus according to claim 1, wherein the exposure section includes:

a first light source which outputs a first light beam;

a second light source which outputs a second light beam;

a light deflector which allows the light beam outputted from the first and second light sources to scan on the photosensitive member surface; and a light detector which detects the light beam outputted from either one of the first and second light sources and outputs a horizontal synchronizing signal, and if the density value detected by the density detection section does not satisfy the predetermined condition after the density correction processing executed by the density correction section is terminated, and the toner remaining amount detected by the toner remaining amount detector is greater than the predetermined remaining amount, and if the horizontal synchronizing signal is outputted from the light detector, the determination section determines that failure has occurred in the light source, among the first and the second light sources, which is not subjected to the light detection executed by the light detector.

6. The image forming apparatus according to claim 5, wherein if the density value detected by the density detection section does not satisfy the predetermined condition after the density correction processing executed by the density correction section is terminated, and the toner remaining amount detected by the toner remaining amount detector is greater than the predetermined remaining amount, and if the horizontal synchronizing signal is not outputted from the light detector, the determination section determines that failure has occurred in at least the light source subjected to the light detection by the light detector among the first and second light sources.

7. An image forming apparatus, comprising:

a photosensitive member having a surface to which a latent image is formed;

a charging section that charges the surface of the photosensitive member;

an exposure section that irradiates a light onto the surface of the photosensitive member charged by the charging section to form the latent image;

a developing section that supplies toner onto the latent image formed on the surface of the photosensitive member to form a toner image;

an intermediate transfer member to which the toner image formed on the surface of the photosensitive member is transferred;

a transfer section that transfers the toner image onto the intermediate transfer member;

a density detection section that detects a density of the toner image transferred to the intermediate transfer member;

a density correction section that executes density correction processing of the toner image forming in a case where a density value detected by the density detection section does not satisfy a predetermined condition;

a toner remaining amount detector that detects a toner remaining amount of a toner accumulation section that supplies toner to the developing section; and a determination section that determines that failure has occurred in the exposure section if the density value detected by the density detection section does not satisfy the predetermined condition after the density correction processing by the density correction section is terminated, and the toner remaining amount detected by the toner remaining amount detector is greater than a predetermined remaining amount, wherein image forming units each including the photosensitive member, the charging section, the exposure section, the developing section, and the transfer section are provided for respective colors for color image forming, and the exposure section includes: a light source which outputs a light beam; and a light deflector allows the light beam outputted from the light source to scan on the surface of the photosensitive member to form the latent image, and at least one of the image forming units for the respective colors further includes a light detector which detects the light beam outputted from the light source and outputs a horizontal synchronizing signal, and if the density value detected by the density detection section does not satisfy the predetermined condition after the density correction processing is executed by the density correction section for each of the image forming units for respective colors, and there is the image forming unit in which the toner remaining amount detected by the toner remaining amount detector is greater than the predetermined remaining amount, the determination section determines that failure has occurred in the light source of the image forming unit under a condition that the image forming unit is not subjected to the light detection executed by the light detector.

8. The image forming apparatus according to claim 7, wherein if the density value detected by the density detection section does not satisfy the predetermined condition after the density correction processing is performed by the density correction section for each of the image forming units for respective colors, and the image forming unit is provided with the light detector, the determination section determines that failure has occurred in the light source of the image forming unit if the light detection is not executed by the light detector, or determines that the toner remaining amount in the toner accumulation section is equal to or less than the predetermined remaining amount if the light detection is executed by the light detector.

9. An image forming apparatus, comprising:

a photosensitive member having a surface to which a latent image is formed;

a charging section that charges the surface of the photosensitive member;

an exposure section that irradiates a light onto the surface of the photosensitive drum charged by the charging section to form the latent image;

a developing section that supplies toner onto the latent image formed on the surface of the photosensitive member to form a toner image;

an intermediate transfer member to which the toner image formed on the surface of the photosensitive member is transferred;

a transfer section that transfers the toner image onto the intermediate transfer member;

a density detection section that detects a density of the toner image transferred to the intermediate transfer member;

a density correction section that executes density correction processing of the toner image forming in a case where a density value detected by the density detection section does not satisfy a predetermined condition;

a toner remaining amount detector that detects a toner remaining amount of a toner accumulation section that supplies toner to the developing section; and a determination section that determines that failure has occurred in the exposure section if the density value detected by the density detection section does not satisfy the predetermined condition after the density correction processing by the density correction section is terminated, and the toner remaining amount detected by the toner remaining amount detector is greater than a predetermined remaining amount, wherein the exposure section includes:

a first light source which outputs a first light beam;

a second light source which outputs a second light beam;

a light deflector which allows the light beam outputted from the first and second light sources to scan on the photosensitive member surface; and a light detector which detects the light beam outputted from either one of the first and second light sources and outputs a horizontal synchronizing signal, and if the density value detected by the density detection section does not satisfy the predetermined condition after the density correction processing executed by the density correction section is terminated, and the toner remaining amount detected by the toner remaining amount detector is greater than the predetermined remaining amount, and if the horizontal synchronizing signal is outputted from the light detector, the determination section determines that failure has occurred in the light source, among the first and the second light sources, which is not subjected to the light detection executed by the light detector.

10. The image forming apparatus according to claim 9, wherein if the density value detected by the density detection section does not satisfy the predetermined condition after the density correction processing executed by the density correction section is terminated, and the toner remaining amount detected by the toner remaining amount detector is greater than the predetermined remaining amount, and if the horizontal synchronizing signal is not outputted from the light detector, the determination section determines that failure has occurred in at least the light source subjected to the light detection by the light detector among the first and second light sources.

* * * * *